United States Patent [19]

Buck

[11] 4,367,907

[45] Jan. 11, 1983

[54] CIRCUIT MONITORING JACK

[75] Inventor: Josef J. Buck, Minneapolis, Minn.

[73] Assignee: Magnetic Controls Company, Minneapolis, Minn.

[21] Appl. No.: 175,353

[22] Filed: Aug. 4, 1980

[51] Int. Cl.[3] ..... H01R 29/00

[52] U.S. Cl. ..... 339/113 R; 339/149 P; 339/183

[58] Field of Search ..... 339/17 C, 113 R, 149 P, 339/150 B, 151 B, 182 R, 183, 91 B, 91 P

[56] References Cited

U.S. PATENT DOCUMENTS

| | | | |
|---|---|---|---|
| 2,428,214 | 9/1947 | Gorey | 339/91 B |
| 3,505,635 | 4/1970 | Williams | 339/91 B |
| 3,537,061 | 10/1970 | Haag et al. | 339/183 |
| 3,744,009 | 7/1973 | Teagno et al. | 339/17 C |
| 4,002,399 | 1/1977 | Deitch et al. | 339/182 R |
| 4,037,913 | 7/1977 | Deitch et al. | 339/182 R |
| 4,138,179 | 2/1979 | Miller et al. | 339/182 R |
| 4,165,147 | 8/1979 | Buck | 339/182 R |

FOREIGN PATENT DOCUMENTS

| | | | |
|---|---|---|---|
| 974786 | 11/1964 | United Kingdom | 339/182 R |

*Primary Examiner*—John McQuade
*Attorney, Agent, or Firm*—Dorsey & Whitney

[57] ABSTRACT

An electrical jack adapted for connection with a printed circuit board having the ability to provide both monitoring access and test access to the circuits therein. The jack includes at least one contact assembly having a pair of contact elements extending across a cylindrical opening in the jack for selectively engaging various contact surfaces of a plug member for purposes of providing either monitoring or testing access.

27 Claims, 12 Drawing Figures

CIRCUIT MONITORING JACK

BACKGROUND OF THE INVENTION

The present invention relates generally to the field of electrical connectors and jacks and more specifically to an improved electrical jack capable of providing both testing and monitoring access. Such jack is adapted for use primarily in the communications industry, however, it is contemplated that it may have application in various other fields such as an audio industry and the like as well.

One type of jack currently existing in the prior art includes a lamination of several spring metal contacts separated by insulators and mounted on one end of a metal frame. These spring metal contacts, when connected with corresponding normal contacts, provide a circuit path for the transmission of data or voice signals. When a suitable plug is inserted into the jack, such circuits are broken, thus providing testing access thereto through various portions of the plug. A second type of jack includes a body portion formed of insulating material and a plurality of wrap-around contact members. These wrap-around contact members extend across a portion of a generally cylindrical opening such that when a plug is inserted into such opening, the contact members make electrical contact with various portions of the plug and break the normal data or voice transmission circuit. Jacks of this type are commonly used in the telephone or communications industry and are described in U.S. Pat. No. 4,165,147.

In each of the above described jacks, insertion of the plug into the jack breaks the normal data or voice transmission circuit and provides testing or split access to such circuit via the plug member. It is often desired, however, to obtain monitor or bridge access to these circuits without breaking the circuits. Neither of the above-identified jacks provides any feature enabling such monitoring access. Thus there is a need in the art for an electrical jack usable in the communications industry having means for providing both testing and monitoring access.

SUMMARY OF THE INVENTION

The jack of the present invention includes a means for providing monitoring or bridging access to the circuitry within the jack as well as normal testing or split access to such circuitry in which the transmission circuit is interrupted. This jack has particular application in the communications industry, however, it is contemplated that it will have various other applications as well. The improved jack of the present invention also includes means for allowing the user to distinguish between the testing access position and the monitoring access position of the inserted plug, thus substantially reducing or eliminating the inadvertent insertion of the plug to the testing access position when the monitor access position is desired.

Specifically, the jack of the present invention includes a general structure similar to that of the jack illustrated in U.S. Pat. No. 4,165,147 having an insulated housing, a cylindrical opening extending through the housing and a plurality of wrap-around electrical contact members. These contact members are normally electrically connected with a corresponding normal contact and are adapted for electrical contact with various portions of a plug upon insertion into the jack. The means of the present invention for providing monitoring access to the transmission circuitry within the jacks includes providing a second spring member with respect to at least one of the wrap-around contact elements. This second spring member permits electrical contact with a portion of the plug while the primary contact member and the normal contact remain electrically connected with one another. Such electrical engagement between the second spring member and the plug enables the circuit to be monitored through the plug.

The means for allowing the user to distinguish between testing and monitor access and for properly positioning the plug in the monitoring position includes a detent member having a portion extending into the cylindrical opening in the housing. This detent member is spring mounted and positioned to seat within a corresponding recessed area in the plug when the plug is inserted into the monitor position.

According, it is a primary object of the present invention to provide an improved electrical jack with means for providing both testing and monitoring access to the electrical circuitry within such jack.

A further object of the present invention is to provide an electrical jack with monitoring access usable primarily in the communications industry.

A still further object of the present invention is to provide an electrical jack with both testing and monitoring access and having means enabling the user to positively detect when such plug is in the monitor and test access positions.

These and other objects of the present invention will become apparent with reference to the drawings, the descriptions of the preferred embodiment and the appended claims.

DESCRIPTION OF THE PREFERRED EMBODIMENT

Figure 1:
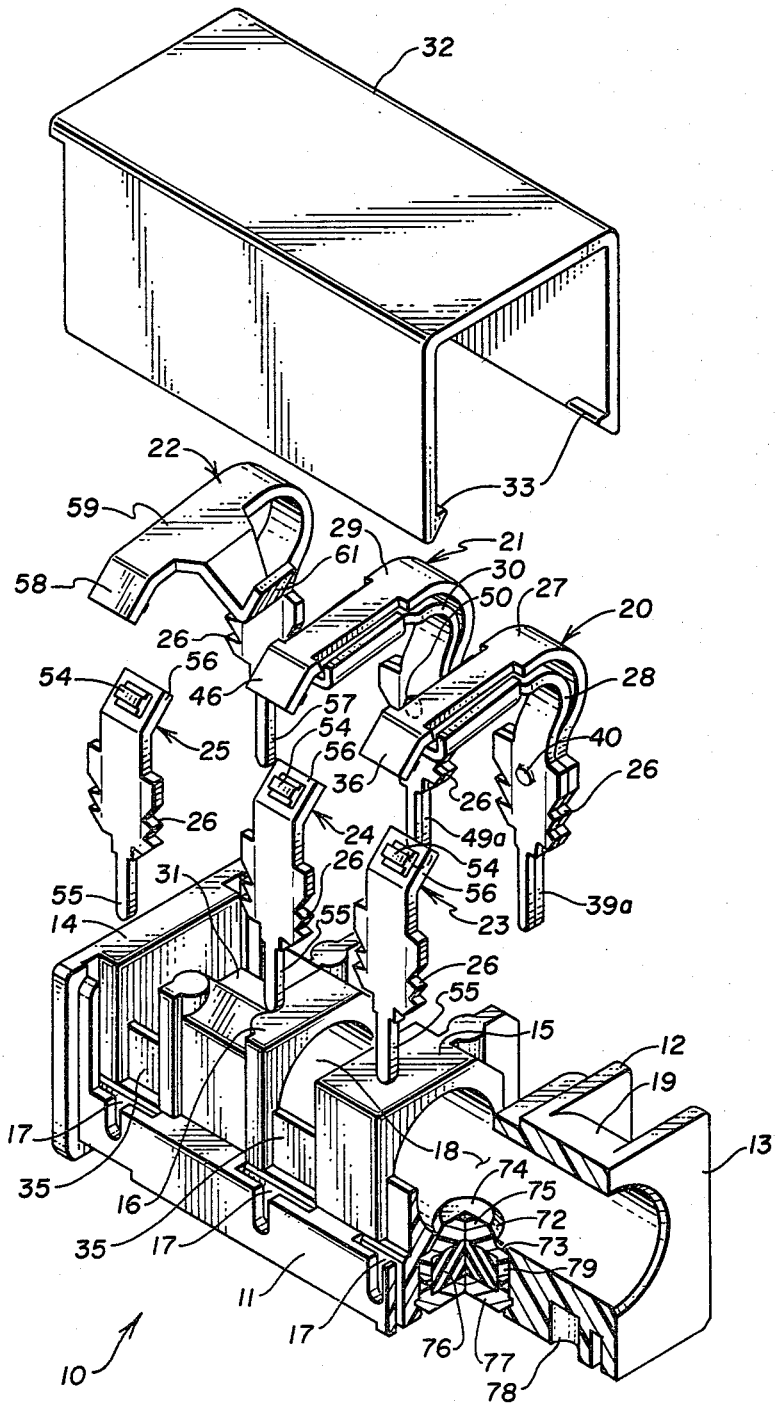
FIG. 1 is an exploded, pictorial view of the improved jack of the present invention showing the spring contact elements and the cover separated from the body portion or housing.

Reference is first made to FIG. 1 showing a pictorial view of the jack of the present invention with various structural parts separated from the elongated non-conductive body or housing portion 10. The body 10 includes a lower base portion 11, a pair of forward walls 12 and 13, a rearward wall 14 and a pair of intermediate walls 15 and 16. The body 10 also includes a cylindrical opening 18 extending substantially through the jack along a longitudinal axis of the housing. The cylindrical opening 18 is defined in part by a forwardly disposed sleeve portion 19, a semi-cylindrically shaped channel portion 35 extending the length of the jack and portions of the intermediate walls 15 and 16. A plurality of spring contact assemblies 20, 21 and 22 extending generally transverse to the opening 18 are adapted for insertion into and retention within openings 17 in the base 11. A plug 67 having tip 62, ring 63 and sleeve 64 contact surfaces (FIGS. 3 and 4) is adapted for insertion into the opening 18 for providing either testing or monitoring access as described below. Each of the contact assemblies 20, 21 and 22 includes a first or generally movable contact member mounted on one lateral side of the opening 18 and extending across the opening 18 and a corresponding second or generally stationary contact member 23, 24 and 25, respectively mounted on the opposite lateral side of the opening 18. Each of the contact members 20–25 includes an intermediate or shaft portion containing a plurality of barbs 26 for retention within the corresponding slots 17 in the base 11. The members 20–25 are positioned such that the movable contact members are adapted for electrical contact with their corresponding stationary or normal contact members 23, 24 and 25 when no plug is inserted within the jack. As will be described in greater detail below, each of the movable contact members includes a pair of spring elements. Specifically, the contact assembly 20 includes spring elements 27 and 28 while the contact assembly 21 includes spring elements 29 and 30. The spring elements 27 and 29 extend across the cylindrical opening 18 and include a contact portion for electrical engagement with the elements 23 and 24, respectively. The spring elements 28 and 30 are positioned below the springs 27 and 29 and are movable with respect thereto to facilitate monitoring access.

The base portion 11 of the jack is shown as being integrally joined with the semi-cylindrically shaped channel portion 35 to define a portion of the cylindrical opening 18. The channel portion 35 extends from the rearward face of the forward wall 12 to the forward face of the rearward wall 14 to totally separate the opening 18 from the bottom of the jack, except for the detent opening as will be described below. This helps in preventing contamination of the contact elements during soldering or flushing of the printed circuit board to which the jack is mounted. The opening 18 is further defined by the sleeve portion 19 which extends forward of the front face of the wall 12 to the forward wall 13. The intermediate walls 15 and 16 are positioned in spaced relationship between the forward wall 12 and the rearward wall 14.

Figure 2:
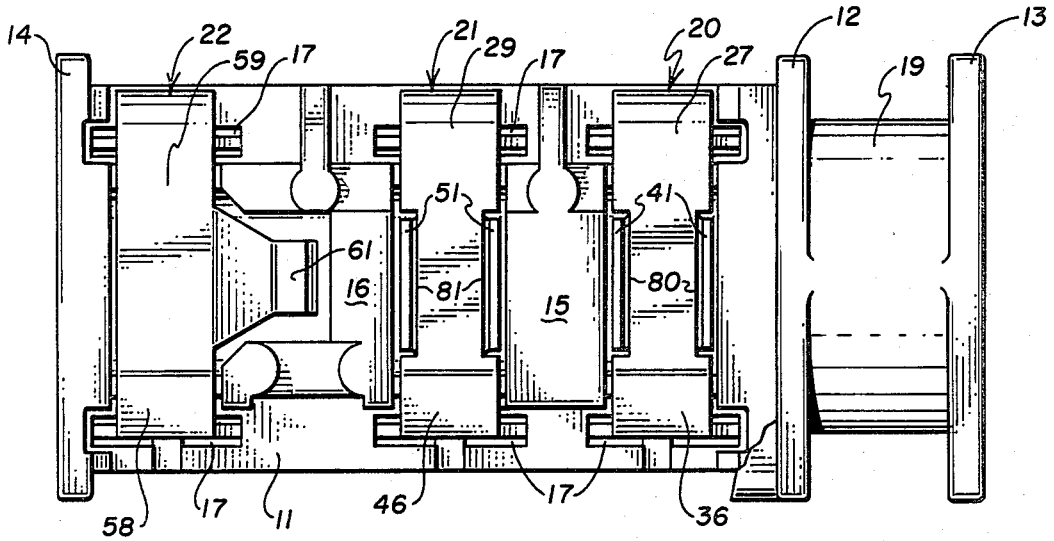
FIG. 2 is a top plan view of the improved jack of the present invention with the cover portion removed.

As illustrated best in FIGS. 1 and 2, the intermediate walls 15 and 16 include sections integrally joined with the base 11 and a portion of the channel 35. The intermediate wall 16 also includes a recessed area 31 to provide room for movement of the tip spring contact member as will be discussed below. Generally transverse openings are disposed between the forward wall 12 and the intermediate wall 15, between intermediate walls 15 and 16, and between the intermediate wall 16 and the rear wall 14 for positioning of the contact assemblies 20, 21 and 22.

The jack also includes a cover portion 32 consisting of a three sided structure having latching tabs 33 positioned at each of its lower corners for appropriate latching engagement with corresponding latches 34 in the base 11. The cover is sized such that it fits over the portion of the housing 10 containing the contact assemblies 20–25. A lip portion at the rear of the cover extends over the top of the rear wall 14. The cover is supported by the sections 14, 15 and 16; thus, installation of the cover 32 does not increase the overall dimensions of the jack. The cover is particularly useful in applications where dust contamination could be a problem.

Figure 6:
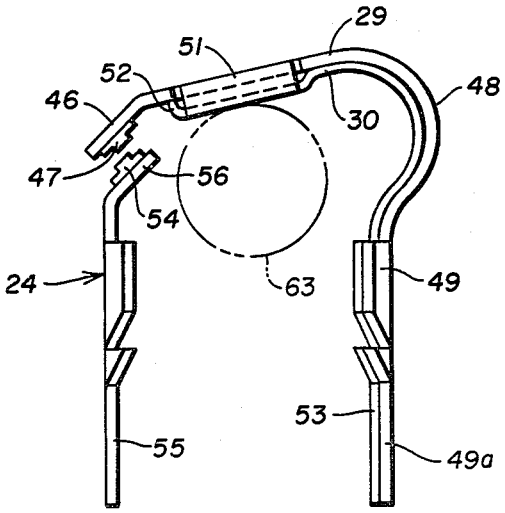
FIG. 6 is a sectional view of the jack of the present invention as viewed along the section line 6—6 of FIG. 3 with the plug in the test access position.
Figure 7:
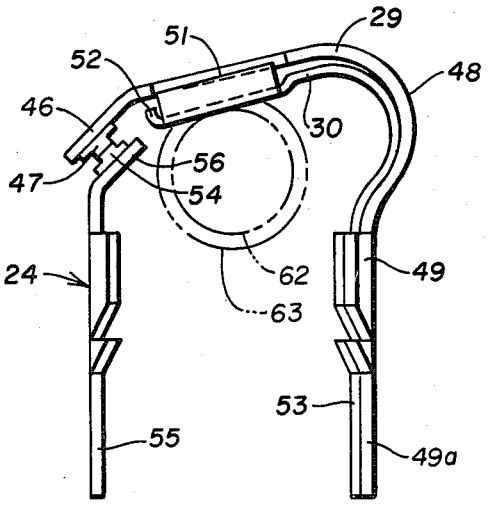
FIG. 7 is a sectional view of the jack of the present invention as viewed along the section line 7—7 of FIG. 4 with the plug in the monitor position.
Figure 8:
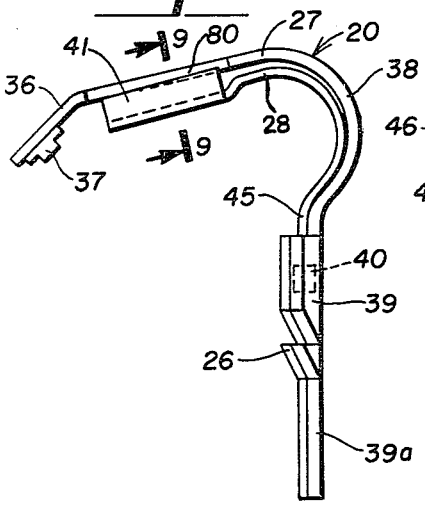
FIG. 8 is a side plan view of the sleeve spring and ring monitor spring of the jack of the present invention.

With reference to FIGS. 2–4 and 6–12, the specific construction of the movable portion of the contact assemblies 20 and 21 can be seen. As shown, the contact assembly 20 includes a first or upper spring member 27 and a second or lower spring member 28. The upper spring 27 is mounted in a cantilevered manner with respect to the base 11 and includes a barbed shaft portion 39 adapted for insertion into one of the elongated slots 17 on one side of the base 11. The barbs 26 are suitably bent and sized to hold the spring 27 firmly in place within the base 11. In the preferred embodiment, a circuit board contacting lug **39*a* is integrally formed with the lower end of the shaft 39 and extends below the surface of the jack base 11 for electrical connection with an appropriate female lug receiving receptacle (not shown). A curved portion 38 extends upwardly and outwardly from the section 39 as shown in FIG. 8 and is integrally joined with a relatively flat section. In the preferred embodiment, the curved portion 38 has a constant radius of curvature through a substantial portion of its curvature and is designed to provide sufficient contact force, while at the same time providing sufficient elasticity to avoid overstressing the spring element. The spring 27 also includes a contact end portion 36 disposed at an angle relative to the generally linear movement of the spring member 27 and a contact surface element 37 adapted for contact with a corresponding surface 54 on the stationary contact element 23. The first spring member 27 is movable between a first position in which it is electrically engaged with the contact member 23 and a second position in which it is electrically disengaged from the contact member 23. As illustrated best in FIG. 2, the spring 27 also includes a pair of elongated recessed portions 80, 80 to accommodate upwardly extending portions 41, 41 of the lower spring 28. These recessed portions 80, 80 restrict the lateral movement of the lower spring 27 relative to the upper spring 28**.

Figure 9:
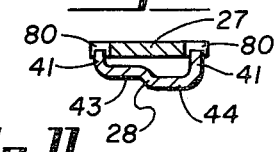
FIG. 9 is a sectional view as viewed along the section line 9—9 of FIG. 8.

The lower spring element 28 includes a lower shaft portion 45 electrically connected with and adapted for positioning adjacent to the portion 39, a curved portion corresponding substantially to the curved section 38 and a forward portion having a pair of upwardly extending side tabs 41, 41. The shaft portions 39 and 45 are secured to each other by the half-punch element 40, by suitable welding or other connection means. As shown in FIG. 9, the edge portions 41, 41 extend upwardly into the recessed areas 80, 80 and are connected to transversely extending portions 43 and 44. During operation of the present jack, the upper surface of the portion 43 is intended to engage the lower surface of the spring 27 while the lower surface of the portion 44 is intended to be engaged and electrically contacted by the inserted plug member 67. As can be seen in FIG. 9 which shows the first and second spring members 27 and 28 in their normal, unstressed positions, initial upward or radially outward movement of the spring portion 28 results in no corresponding movement of the spring 27 until the upper surface of the portion 43 engages the lower surface of the spring 27. Thereafter, further upward or radially outward movement of the spring 28 results in corresponding upward movement of the spring 27 to its second position in which it is electrically disconnected from the contact member 23.

Figure 10:
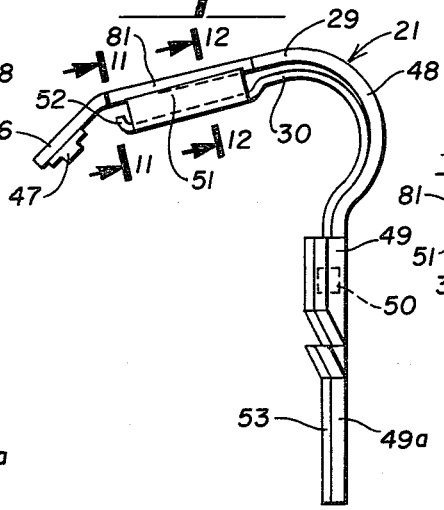
FIG. 10 is a side plan view of the ring spring and tip monitor spring of the jack of the present invention.
Figure 11:
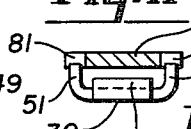
FIG. 11 is a sectional view as viewed along the section line 11—11 of FIG. 10.
Figure 12:
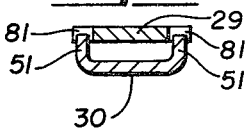
FIG. 12 is a sectional view as viewed along the section line 12—12 of FIG. 10.

The movable portion of the contact assembly 21 is illustrated best in FIGS. 10, 11 and 12. Specifically, the movable portion includes a first or upper spring member 29 having a barbed shaft portion 49 adapted for insertion into one of the elongated slots 17 on the side of the base 11, a curved portion 48 extending upwardly from the shaft 49 and a contact end 46. The contact end 46 includes a contact surface element 47 on its underside for electrical engagement with a surface contact element 54 on its corresponding stationary contact element 24. The spring 29 is movable between a first position in which it is electrically engaged with the contact member 24 and a second position in which it is electrically disengaged from the contact member 24. A circuit board connecting lug 49*a* is integrally joined with the lower end of the shaft 49 for connection with an appropriate printed circuit board. As shown best in FIG. 2, the spring 29 also includes a pair of elongated recessed areas 81, 81 to accommodate the upwardly extending portions 51, 51 of the lower spring 30. These recessed areas 81, 81 restrict the lateral movement of the spring 30 relative to the spring 29.

The second or lower spring element 30 includes a shaft portion 53 electrically connected with and disposed adjacent to the shaft 49 and a curved portion extending upwardly from the shaft 53 conforming substantially to the curved portion 48 of the spring element 29. In the preferred embodiment, the shaft portions are secured together by the half-punch means 50. The contact end of the second spring member 30 includes a pair of upwardly extending tab portions 51, 51 extending into the recessed portions 81, 81 of the spring member. The second spring 30 also includes an upwardly extending tab portion 52 extending along the forward edge and transverse to the longitudinal axis of the spring. During operation, initial upward or radially outward movement of the spring 30 results in no corresponding upward movement of the spring element 29; however, once the upper edge of the tab 52 engages the bottom surface of the spring member 29, further upward or radially outward movement of the spring 30 results in corresponding upward movement of the spring 29 to its second position.

The tip contact assembly 22 consists of the movable spring element 59 and the stationary contact member 25. The movable spring 59 includes a body or shaft portion with a plurality of barbs for retaining the same within the base 11 and a printed circuit board contact lug 57 extending below the base 11 for electrical connection with a printed circuit board. The spring 59 also includes a curved portion extending upwardly and outwardly from the shaft section, an elongated section connected with the curved portion and a contact end 58. The lower surface of the end 58 includes a contact element for electrical engagement with the corresponding contact element 54 on the stationary contact member 25. The spring 59 also includes a tip contact portion comprising the generally V-shaped element 61. The element 61 is integrally formed with the spring 59 and extends forwardly and downwardly with respect thereto. As illustrated best in FIG. 3, this element 61 is adapted for making electrical contact with the tip portion 62 of the plug when the plug 67 is in its fully inserted or test access position.

Figure 5:
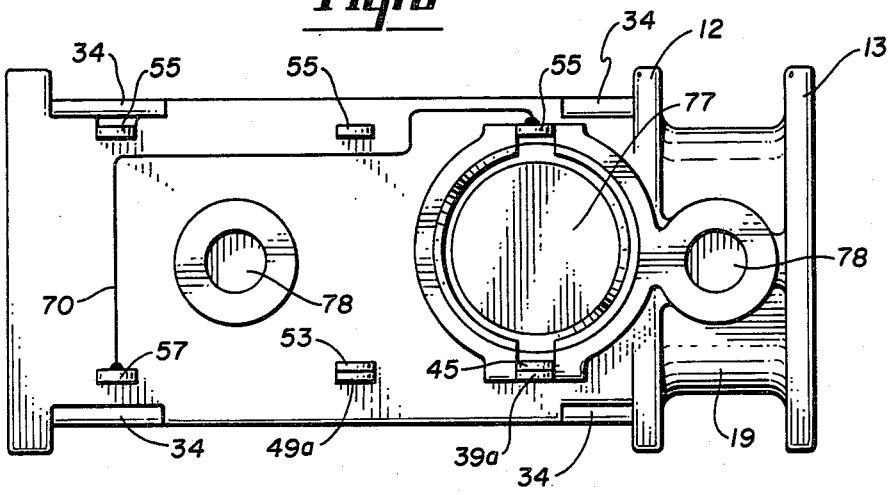
FIG. 5 is a bottom elevational view of the back of the present invention.

Each of the stationary contact members 23, 24 and 25 includes a shaft portion for insertion into appropriate openings 17 in the base 11 where it is retained by a plurality of barbs 26. A printed circuit board contact lug 55 extends from the lower end of the shaft for connection with a printed circuit board. As illustrated in FIG. 5 showing the bottom of the jack, the PCB lug 57 of the tip spring 22 (FIG. 1) is electrically connected with the lug 55 of the sleeve normal spring via the connecting element 70. This enables the tip circuit to be monitored as hereinafter discussed. The upper end of the members 23–25 includes an angled contact end 56 having a contact element 54 for electrical engagement with the corresponding contact elements of the contact ends 36, 46 and 58.

Figure 3:
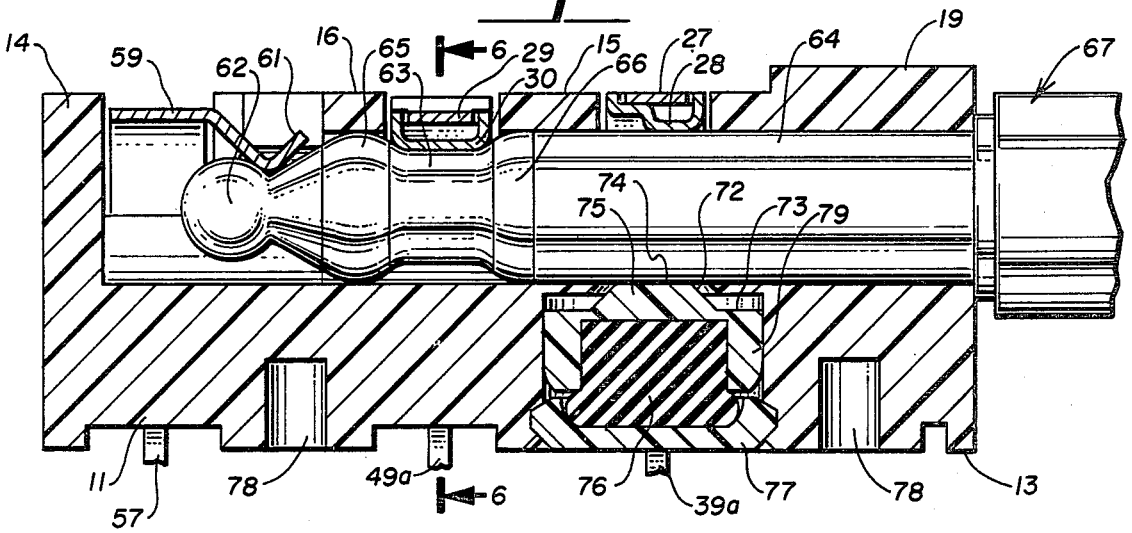
FIG. 3 is a side view, partially in section, of the jack of the present invention with the plug fully inserted in the test access position.
Figure 4:
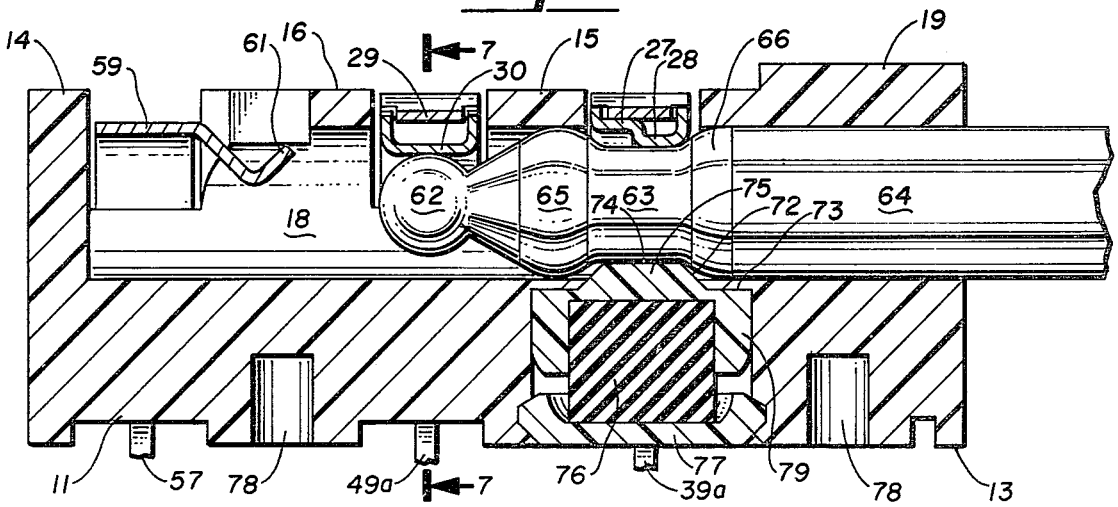
FIG. 4 is a side view, partially in section, of the jack of the present invention with the plug partially inserted in the monitor access position.

With reference to FIGS. 3 and 4, the plug member 67 is adapted for insertion into the opening 18 into two different positions. FIG. 3 shows the plug 67 fully inserted into the jack member in its test access position while FIG. 4 shows the plug 67 partially inserted into the jack in its monitor position. When the plug 67 is in its test access position as shown in FIG. 3, the spring 28 engages the sleeve portion 64, the spring 30 engages the ring portion 63 and the tip spring member 61 engages the tip portion 62. As shown in FIG. 6, when the plug 67 is fully inserted into the jack in the test access position, the ring portion 63 raises the spring elements 29 and 30 sufficiently to raise the contact end 46 and break the electrical contact between the contact surface 47 and the corresponding contact surface 54 on the stationary contact 24. A similar situation exists with respect to the contact assembly 20 when the plug 67 is fully inserted. Specifically, engagement of the spring 28 by the sleeve portion 64 results in sufficient upward or radially outward movement of the contact spring elements 27 and 28. This movement raises the contact end 36 and breaks the electrical contact between the contact element 37 and the element 54 of the contact member 23. Full insertion of the plug 67 also causes engagement between the tip 62 and the spring portion 61, thus raising the spring 59 and breaking contact between the elements 58 and 25.

FIG. 4 shows the plug 67 in its monitor position in which the plug is inserted only partially within the jack. In this position the tip portion 62 of the plug 67 is electrically engaged by the lower spring member 30 and the ring portion 63 is electrically engaged by the lower spring member 28. As shown in FIG. 7, however, such contact does not result in outward movement of these springs sufficient to break electrical engagement between the movable contact elements and their corresponding stationary members 23 and 24. Thus, monitoring of the electrical circuit normally existing in the tip spring 22 is facilitated by the ring portion 63 of the plug, because of the connection 70 (FIG. 5) between the lugs 57 and 55, and the electrical circuit normally existing between the movable contact springs 29 and 30 and the stationary contact member 24 can be monitored through the tip portion 62 of the plug 67.

The foregoing can be accomplished because of the differences in the diameters of the tip 62, ring 63 and sleeve 64 portions of the plug 67. Specifically, the tip 62 has the smallest diameter, the ring 63 has the next smallest and the sleeve 64 has the largest. Thus, to function as described above, the relationship between the springs 27 and 28 must be such that when the ring portion 63 is positioned adjacent to these springs, electrical contact is made between the spring 28 and the ring 63 without raising the spring 27 and breaking contact with the element 23, whereas when the sleeve portion 64 is positioned adjacent the springs 27 and 28, the springs 27 and 28 must be raised sufficiently to break contact with the element 23. Similarly, the relationship between the springs 29 and 30 must be such that when the tip portion 62 is positioned adjacent to these springs, electrical contact is made between the spring 30 and the tip 62 without raising the spring 29 and breaking contact with the element 24, whereas when the ring portion 23 is positioned adjacent the springs 29 and 30, the springs 29 and 30 must be raised sufficiently to break contact with the element 24.

With reference to FIGS. 3 and 4, the plug 67 is shown as including a pair of insulated sections 65 and 66 which physically separate and electrically insulate the various portions of the plug from one another. Specifically, the insulated portion 65 separates the tip 62 and ring 63 portions, while the insulated portion 66 separates the ring 63 and sleeve 64 portions. As the plug 67 is inserted into the jack, the lower spring member 28 first contacts either the tip portion 62 or a portion of the insulated section 65 since this is the first part of the plug that interferes with the normal, unstressed position of the lower spring member 28. As the plug is inserted further, the lower spring member rides upwardly on the insulated section 65 to a point where the upper surface of the lower spring 28 engages the lower surface of the upper spring 27. When this occurs, further insertion of the plug 67 causes the electrical connection between the spring 27 and the stationary contact 23 to be momentarily broken. Further insertion, however, allows the lower spring member 28 to fall back into the sleeve portion 63 of the plug as illustrated in FIG. 4. In this position, the lower spring member 30 is electrically engaged with the tip portion 62 for monitoring the ring circuit, while the tip spring member 59 is electrically engaged with the ring portion 63, via the connecting wire 70 (FIG. 5), the sleeve normal lug 55 and the springs 27 and 28 for monitoring the tip circuit.

The present invention also includes means for allowing the user to positively determine when the plug 67 is in the monitor position. This is an important aspect of the present invention since if the plug 67 is inadvertently inserted into the jack too far, when such insertion is not intended, undesirable results can occur. Momentary breaking of the circuit of the contact assembly 20 does not adversely affect operation of the jack. In fact, such breaking of the circuit 20 occurs during insertion of the plug into the monitor position. However, if the circuit of the contact assembly 21 is inadvertently broken and data is being transmitted, significant data can be lost. If the transmission is a voice transmission, the user will hear a click or other interference if the circuit is broken. Thus, it is important to provide the user with means for determining when the plug is in the monitor position. In the present invention, this is accomplished by the detent mechanism illustrated best in FIGS. 1, 3 and 4. The detent mechanism includes a detent disc member 75 disposed within the insulated housing section of the jack 10. The detent disc 75 includes an upper surface portion 73 which engages an interior portion of the housing to retain the same therein. The disc 75 also includes a raised portion 74 which normally extends through an opening 72 in the cylindrical opening 18 and a peripheral retaining flange 79 extending downwardly toward the bottom surface of the jack. The retaining flange 79 retains a bias member 76 disposed between the detent disc 75 and a lower detent retention cover 77 secured within the bottom portion of the housing 11 by means such as ultrasonic welding. The function of the bias member 76 is to exert a bias force upwardly against the detent disc 75. Although it is contemplated that the bias member 76 can take several different forms such as a coil spring member or the like, the member 76 in the preferred embodiment is a compressible rubber column or pad. The rubber column 76 in the preferred embodiment has a Shore A durometer of approximately 75.

As illustrated particularly in FIG. 4, when the plug 67 is inserted into the jack, the detent disc 75 is depressed as it passes the insulative portion 65 and then seats within the ring section 63 between the insulative portions 65 and 66. Additional force is then necessary to insert the plug further. Thus, as the plug 67 is inserted the user is provided with a positive indication that the plug is in the monitor position.

As shown best in FIG. 5, the jack of the present invention is secured to the printed circuit board by a pair of screws which extend into the threaded recesses 78, 78.

Although the description of the preferred embodiment has been quite specific, it is contemplated that various changes and modifications could be made to the structure without deviating from the scope of the present invention. Thus, it is intended that the scope of the present invention be dictated by the claims rather than by the description of the preferred embodiment.

I claim:

1. An electrical jack comprising:

an elongated housing having a generally cylindrical opening therein for insertion of a plug member having first and second electrical contact portions;

at least one contact assembly mounted in said housing and including a first contact member having a portion extending transversely across said cylindrical opening and a second contact member adapted for selective electrical contact with said first contact member, said first contact member including a first contact element movable between a first position in which said first contact element and said second contact member are electrically engaged and a second position in which said first contact element and said second contact member are electrically disengaged and a second contact element disposed generally radially inwardly of said first contact element and electrically connected therewith, said second contact element being adapted for selective electrical engagement with the first and second contact portions of the plug member, and being movable in a generally radial direction between first and second positions as a result of such engagement with the first and second contact portions of the plug member; and means for moving said first contact element between its first and second positions in response to movement of said second contact element between its first and second positions, respectively.

2. The electrical jack of claim 1 wherein said first and second contact elements include first and second contact springs.

3. The electrical jack of claim 2 wherein said first contact spring is biased toward electrical engagement with said second contact member.

4. The electrical jack of claim 3 including limit means for restricting the lateral movement of said second contact spring relative to said first contact spring.

5. The electrical jack of claim 4 wherein said limit means includes a pair of edge tabs extending radially outwardly from said second contact spring on opposite sides of said first contact spring.

6. The electrical jack of claim 5 wherein said first contact spring includes a recessed portion of each lateral side and said edge tabs extend into said recessed portions.

7. The electrical jack of claim 2 wherein said second contact spring is biased toward an unstressed position disposed radially inwardly of its first position and said second contact spring is movable in a generally radial direction between said unstressed and first positions relative to said first contact spring.

8. The electrical jack of claim 2 wherein each of said first and second contact springs includes a shaft portion retained within said housing, a curved portion extending from said shaft portion and a portion extending generally transversely across said cylindrical opening.

9. The electrical jack of claim 8 wherein said first contact spring further includes a contact end for selective electrical engagement with said second contact member.

10. The electrical jack of claim 1 including detent means enabling the user to physically detect when said second contact element is in electrical contact with the first contact portion of the plug member.

11. The electrical jack of claim 10 wherein said detent means includes a detent member having a portion extending into said cylindrical opening.

12. The electrical jack of claim 11 including bias means for biasing said detent member toward said cylindrical opening.

13. The electrical jack of claim 12 wherein said bias means includes a column of compressible rubber.

14. The electrical jack of claim 1 having means for connection with a printed circuit board.

15. An electrical jack adapted for insertion of a plug member having a plurality of contact surfaces to selectively provide either testing or monitoring access to the circuits within the jack, said jack comprising:

a housing having an opening therein for insertion of the plug member;

first and second normal contact members mounted in said housing on one lateral side of said opening;

a first contact spring associated with each of said first and second normal contact members, each of said first contact springs being mounted in said housing on an opposite lateral side of said opening as said first and second normal contact members and having a free contact end movable between a first position in which it is electrically engaged with its corresponding normal contact member and a second position in which it is electrically disengaged from its corresponding normal contact member;

a second contact spring electrically connected with each of said first contact springs, disposed radially inwardly from said first contact spring and having a portion capable of limited movement in a radial direction relative to said first contact spring between an unstressed, radially innermost position and a monitor position in which said second contact spring is in electrical contact with one of the contact surfaces of the plug member and said first contact spring is in its first position, said second contact spring capable of further limited movement in a radially outward direction together with said first contact spring between said monitor position and a test position in which said second contact spring is in electrical contact with a second contact surface of the plug member and said first contact spring in its second position.

16. The electrical jack of claim 15 including limit means for restricting the lateral movement of said second contact spring relative to said first contact spring.

17. The electrical jack of claim 16 wherein said limit means includes a pair of edge tabs extending radially outwardly from said second contact spring on opposite sides of said first contact spring.

18. The electrical jack of claim 17 wherein said first contact spring includes a recessed portion on each lateral side and said edge tabs extend into said recessed portions.

19. The electrical jack of claim 15 including means causing movement of said first contact spring between its first and second positions as the result of movement of said second contact spring between its monitor and test positions.

20. The electrical jack of claim 15 including a third normal contact member mounted in said housing on the same lateral side of said opening as said first and second normal contact members and including a third contact spring mounted in said housing on an opposite lateral side of said opening as said third normal contact member and having a free end movable between a first position in which it is electrically engaged with said third normal contact member and a second position in which it is electrically disengaged from said third normal contact member.

21. The electrical jack of claim 20 including means electrically connecting said third contact spring and said first normal contact member.

22. The electrical jack of claim 21 wherein said plug member includes first, second and third contact surfaces corresponding to tip, ring and sleeve contact surfaces, respectively.

23. An electrical jack comprising an elongated housing having a generally cylindrical opening therein for insertion of a plug member having a plurality of contact portions;

a plurality of contact assemblies mounted in said housing including a first contact member having a portion extending transversely across a portion of said opening and one end secured in said housing on one lateral side of said cylindrical opening and further including a second contact member having one end secured in said housing on the other lateral side of said cylindrical opening, each of said first and second contact members including a second end adapted for normal electrical engagement with each other;

means facilitating the monitoring of the electrical circuits of at least one of said contact assemblies upon insertion of said plug member into said opening to a monitor position and facilitating the testing of the electrical circuits of at least one of said contact assemblies upon insertion of said plug member into said opening to a test position, said means including a contact spring electrically connected with said first contact member and having a portion adapted for electrical engagement with a contact portion of said plug member, said means further including means for electrically disengaging said second ends of said first and second contact members when said plug member is in its test position; and means enabling the user to physically detect when said plug member is inserted into said monitor position.

24. The electrical jack of claim 23 wherein said means enabling the user to physically detect when said plug member is inserted into said monitor position includes detent means.

25. The electrical jack of claim 24 wherein said detent means includes a detent member having a portion extending into said cylindrical opening.

26. The electrical jack of claim 25 including bias means for biasing said detent member toward said cylindrical opening.

27. The electrical jack of claim 26 wherein said bias means includes a column of compressible rubber.

* * * * *